US006074737A

United States Patent [19]

Jordan et al.

[11] Patent Number: 6,074,737

[45] Date of Patent: Jun. 13, 2000

[54] FILLING POROSITY OR VOIDS IN ARTICLES FORMED IN SPRAY DEPOSITION PROCESSES

[75] Inventors: Richard Michael Jordan, Oxfordshire; Allen Dennis Roche, Aberdare, both of United Kingdom

[73] Assignee: Sprayform Holdings Limited, Swansea, United Kingdom

[21] Appl. No.: 09/142,193

[22] PCT Filed: Mar. 4, 1997

[86] PCT No.: PCT/GB97/00590

§ 371 Date: Sep. 1, 1998

§ 102(e) Date: Sep. 1, 1998

[87] PCT Pub. No.: WO97/33012

PCT Pub. Date: Sep. 12, 1997

[30] Foreign Application Priority Data

Mar. 5, 1996 [GB] United Kingdom ..... 9604707

[51] Int. Cl.[7] ..... B32B 3/26

[52] U.S. Cl. ..... 428/312.8; 428/306.6; 428/307.3; 428/307.7; 428/312.2

[58] Field of Search ..... 428/306.6, 307.3, 428/307.7, 312.2, 312.8

[56] References Cited

U.S. PATENT DOCUMENTS 3,848,307 11/1974 Kydd ..... 29/156.8 B

FOREIGN PATENT DOCUMENTS

| | | |
|---|---|---|
| 2 702 496 | 3/1996 | France . |
| 60116759 | 6/1985 | Japan . |
| 61204365 | 9/1986 | Japan . |
| 62182266 | 8/1987 | Japan . |
| WO 96/09421 | 3/1996 | United Kingdom . |

OTHER PUBLICATIONS

"Liquid–Mn Sintering Of Plasma–Sprayed Zirconia–Yttria Coatings", by Ohmori et al. in Thin Solid Films, vol. 251, No. 2, Nov. 1, 1994.

*Primary Examiner*—Helen L. Pezzuto
*Attorney, Agent, or Firm*—Bliss McGlynn, P.C.

[57] ABSTRACT

Porous regions or void regions of spray deposited articles of one composition are infilled with molten material of a differing composition which subsequently solidifies. The molten material flows to infill the porous or void regions under the influence of applied pressure or capillary type action. Typically, the sprayed material is molten metallic material, and the void porosity filling material is also metallic in composition but having a lower melting point.

32 Claims, No Drawings

FILLING POROSITY OR VOIDS IN ARTICLES FORMED IN SPRAY DEPOSITION PROCESSES

BACKGROUND OF THE INVENTION

1. Field of the Invention

The present invention relates to processes for reducing or sealing porosity and filling voids in spray deposited articles, and also to articles formed by such processes.

2. State of Art

Processes for forming articles by means of molten metallic spray deposition techniques (sprayforming) are well known and described, for example, in GB-A-1255862 and WO-A-95/12473. In order to control distortion in sprayed metal deposits it has been proposed to tailor the spraying conditions to control or "balance" the various stresses set up within the cooling deposit. This is particularly the case for crystalline phase change materials such as steels, where the deposition conditions may be tailored to ensure a phase change within the deposited material giving a stress relieving volume change. Such techniques are described in WO-A-96/09421.

A major problem with such techniques is that it is often necessary, in order to ensure the required conditions for stress control, to deposit the material at a lower spray temperature than would normally be chosen for sprayforming applications in which stress control is less critical (for example in depositing thin coatings). Because of the relatively low spraying temperature (preferably below 250–300 Celsius for steels) the sprayform splats do not coalesce particularly well upon deposition which results in a deposit of relatively high porosity; this is a particular problem where the porosity is interconnected. Interconnected porosity occurs where spaced regions within the deposited material are connected by a network of porosity which allows gas or liquid to permeate or percolate between the spaced regions. It is a particular problem where interconnected porosity communicates with a region of porosity at a surface of the deposit (such as a working surface of a mould or die), or with cavities or bores intended to carry or retain fluids (such as coolant channels provided in the article) because leakage may occur. This would be important, for example where the article is a plastic injection moulding tool provided with internal cooling channels, or where leakage of vacuum could occur for tooling used in autoclave applications (for example, in aerospace tooling for making composite layups).

Furthermore, any significant porosity at the working surface of a mould tool or die results in a poor surface finish when the tool is subsequently polished.

As mentioned above these problems of porosity (and also the setting up of internal stresses) are inherently associated with various sprayforming techniques where material is deposited at a relatively low temperature for various reasons that may be desirable. This is because of the nature of the process, in which the deposit is built up from a multiplicity of molten splats of material comprising molten droplets which cool upon impact with a substrate or earlier deposited splats. Such problems do not typically occur with other techniques in metallurgy and other fields, such as for example plasma spraying or flame spraying techniques in which the material sprayed is at substantially higher temperatures (typically 500–800 Celsius for steels).

A further problem associated with sprayforming techniques is "shadowing" which is prone to occur when sprayed material is prevented from impinging upon a particular surface portion by instead impinging upon a "masking" portion of either previously deposited material or the pattern or substrate upon which the deposit is being built up. Such "shadowing" effects frequently result in voids being formed in the interior of a sprayed deposit.

SUMMARY OF THE INVENTION

An improved technique for reducing porosity and voids in spray deposited material has now been devised.

According to the invention, there is provided a process for reducing porosity or voids in a region of an article comprised of spray deposited material of a first composition, the process comprising at least partially infilling the porous region or void with molten material of a second composition which subsequently solidifies.

In certain circumstances, it is preferred that a wetting agent is employed to enhance the process, particularly where the first and/or second composition material is metallic. The wetting agent preferably comprises a flux material suitable for removing oxide skin formed during or subsequent to deposition.

The porous region or void is preferably infilled by the molten material flowing under the influence of pressure (advantageously induced by heating) or capillary type action.

It is preferred that the material of the first composition has a melting point higher than the melting point of the material of the second composition.

Material of the second composition may be encompassed within the sprayed deposit of material of the first composition, the temperature of the material of the second composition being elevated under conditions tailored to effect:

i) melting of at least a portion thereof; and, ii) flow of melted material of the second composition to penetrate and at least partially infill porous regions of, or voids in, the deposited material of the first composition.

The material of the second composition is effectively enclosed, encapsulated or embedded within (or walled by) material of the first composition prior to being melted to flow to infill or partially infill porous regions or voids.

In one embodiment, material of the second composition may be introduced (in molten or solid form) into receiving cavities or bores provided in the spray deposited article. In this embodiment, the cavities or bores are subsequently sealed or plugged to encapsulate the second composition material before the temperature is elevated to cause the second composition material to melt and flow to infill or partially infill the porous regions or voids in the first composition material.

In an alternative embodiment, the material of the second composition is preferably embedded within the sprayed deposit of the first material composition during spraying. The material of the second composition is advantageously melted to flow either by subsequent heating of the article when substantially formed, or by tailoring the spray temperature of the first composition material and/or the temperature of the deposit during spraying, such that following embedding in the deposit, the melting point of the second material composition is attained by the effect of continued spraying.

Substantially entirely embedding, encapsulating, sealing or enclosing the material of the second composition enables sufficient pressure to be generated in the region occupied thereby to cause penetration into the porous region or void of the deposit of the first material composition.

Where, subsequent to operation of the process, the space previously occupied by the second composition material is empty, the empty space may define cooling means (such as cooling channels) arranged to carry a coolant fluid. This is a particularly synergistic aspect of the invention because reduced porosity is important where cooling channels are defined through spray deposited material to prevent leakage of the coolant through the material porosity.

In a yet further embodiment, molten sprays of the first and second material composition may be sprayed coincidentally to form the spray deposited article. This has the surprising effect that, under the correctly tailored spraying conditions, the lower melting point second material composition flows to penetrate/migrate into the porous network of the first material composition without the need for further heating of the deposit. The sprays may be sprayed coincidentally either by using separate sprays of the first and second composition originating from separate spray sources (guns). Alternatively, a single spray source (gun) may be used spraying either simultaneously or intermittently sprays of differing composition. Feed stock feeding the spray source (gun) may comprise material of both compositions.

It is believed that the effect occurs in this instance substantially due to capillary action of material of the second composition (low melting point) into the porosity network of the material of the first composition (high melting point). This effect is considerably enhanced where the spraying conditions are tailored such that oxidation of the surface of the porosity network of the deposit, and of the surface of the second material composition are minimised during deposition to minimise surface energy effects that could otherwise prevent capillary action. It is preferred therefore that a relatively unreactive/inert gas (such as nitrogen) is utilised primarily in the spraying process; although the process has also been found to work well where air alone, or mixtures of air and lower proportions of inert gas are used.

In one embodiment, it is preferred that the first composition material is deposited by spraying atomised molten metal droplets (preferably steel) forming splats upon impact with earlier deposited material thereby building up the article.

Desirably, the steel is deposited by spraying as atomised droplets at a spray temperature at or below 350 celcius (preferably at or below 300 celcius).

Preferably a martensitic phase transformation takes place in the deposited steel; this can have the effect (under tailored deposition conditions) of relieving internal stresses within the article. According to another aspect, the invention provides an article comprised of spray deposited material of a first composition, having porosity or void regions at least partially infilled with solidified material of a second composition.

The porous or void regions are preferably infilled or partially infilled with molten material of the second composition which subsequently solidifies.

At least one of the first and second compositions is preferably metallic. The second composition material may also be metallic; alternatively non metallic sealing material may be used such as plastics materials capable of curing following flowing to fill or seal porosity. Desirably the melting point of the first composition material is substantially higher than that of the second composition material.

DETAILED DESCRIPTION OF THE PREFERRED EMBODIMENTS

The invention will now be further described in specific embodiments by way of explanation and example with reference to the following examples which utilise standard metal sprayforming apparatus known in the art.

EXAMPLE 1

A substrate tool (die/mould) pattern was mounted on a manipulator and moved rapidly beneath two arc spray guns fed with 0.8% C steel wires. The manipulator was programmed to produce an initial deposited layer of approximately 5 mm. Spraying of the 0.8% C steel wire was then halted briefly allowing time for a low melting point rod to be positioned on the sprayed surface to define the location and geometry of cooling channels to be formed in the tool. The low melting point rod (lead in this case) was sufficiently ductile to easily conform closely with the topographic features of the sprayed surface. After positioning the low melting point alloy, and while the deposit was still hot, spraying of the 0.8% C steel was re-started with the manipulator programmed to give a minimum of shadowing and a reasonably flat top surface to the tool. The final thickness of tool was approximately 20 mm, with the low melting point material completely encapsulated by the 0.8% C steel. The spray conditions were such that the temperature of the deposit during the spray deposition process was less than the melting point of the low melting point Pb rod. The deposit was then placed in an oven set at a temperature above the melting point of the Pb rod, i.e. approximately 400° C., and soaked at that temperature for approximately one hour prior to then cooling slowly to room temperature. The ends of the low melting point rod were then exposed by grinding away the sprayed steel deposit. The whole tool was then re-heated to melt and drain away the low melting point rod material.

On sectioning the tool for metallurgical examination it was found that a substantial proportion of the porosity in the sprayed steel had been penetrated and filled by the molten Pb. The water cooling channel defined by the position of the lead rod did not leak under an applied water pressure of 5 bar; furthermore, the lead was found to have penetrated to the surface of the tool in sufficient quantity to substantially fill surface porosity, thereby allowing a high quality polished working surface to be provided in post spray finishing of the tool.

EXAMPLE 2

In this case the same procedure was adopted as in Example 1, but spray deposition conditions for the second stage of the process, during the build-up of sprayed metal over the low melting point rod, were altered by increasing the power input into the two arc spray guns. The temperature of the deposit during this part of the spray process was thus raised above the melting point of the rod. When cool, the deposit was machined to expose an opening for the rod material to be melted out when subsequently heated in the oven to a temperature above the melting point of the rod material.

On sectioning the tool for metallurgical examination it was again found that most of the porosity (including porosity at the working surface) in the sprayed steel had been penetrated and filled by the molten Pb. This provided the same benefits described for example 1 above.

The above Examples both illustrate how porosity in steel tooling can be filled simultaneously with the incorporation of cooling channels in the body of the tool. It will be understood that it is not necessary to combine these two operations, merely convenient to do so under certain circumstances where it is desired to also lay in cooling channels for the tooling to perform to a particular technical requirement.

When cooling channels are not required in the final product, or where it is more convenient to simply drill cooling channels in a separate process following spray deposition, then provision to fill porosity according to the present invention can be made in two alternative ways. Firstly, the spray deposition process can be interrupted at some chosen point in order to simply place a piece of low melting point material down onto the deposit. The spray deposition process can then be resumed, as already illustrated by Examples 1 and 2, and the low melting point material subsequently either melted in situ during sprayforming or later by the application of heat. Secondly, cooling channels can be filled after sprayforming. These are then filled with liquid low melting point alloy which is subsequently allowed to freeze. The entries to the cooling channels are then plugged and the low melting point alloy then re-melted to fill the porosity channels under the pressure generated. After filling the porosity in this way the plugs are then removed and the low melting point alloy melted out.

The pressure generated on melting the low melting point material is sufficient to cause substantially complete penetration of the interconnected porosity in the deposit.

EXAMPLE 3

The tooling pattern was mounted on a manipulator and moved rapidly beneath a single arc spray gun fed with 1.6 mm aluminium wire and 1.6 mm 0.8% C steel wire. The spray conditions were as follows:

200 amps, 38 volts, 50 psi primary (Nitrogen), 50 psi secondary (Nitrogen).

The manipulator was programmed to produce a deposit thickness of 6 mm. The spray conditions were such that the average temperature of the deposit was less than the melting point of aluminium, but surprisingly the porosity levels observed in the final product were substantially less than would otherwise have been observed for the 0.8% C steel sprayed by itself under the above conditions.

It is believed that penetration of porosity in this way, during simultaneous spray deposition of low and high melting point materials is achieved substantially by capillary action of the low melting point alloy into the porosity network of the high melting point alloy. This is significantly enhanced if both the porosity and also the surface of the low melting point alloy are substantially free of oxidation at the time penetration occurs, in order to minimise the surface energy effects that would otherwise limit penetration by capillary action. But during sprayforming, due to the way the process is typically operated, this will be substantially the case for the very short periods of contact required during co-deposition in order to achieve the effect, because as both materials are sprayed and splats are formed, a substantial amount of new and clean surface is created in both the lower and higher melting point materials. This new surface will initially be substantially un-oxidised, particularly where the gas being used in the spray process is nitrogen or an inert gas. So capillary action is enhanced under such conditions, and this leads to the substantial penetration of porosity that is observed in practice during this embodiment of the invention.

As a result of post spray metallurgical observations, it appears that even where very little time exists prior to freezing of the lower melting point material, as would be the case with the above example, there is nevertheless adequate time for penetration of porosity by capillary action. Furthermore, this effect is facilitated where both the new surface of the low melting point material, and also the surfaces within the porosity are substantially clean and free of oxide, even for extremely short periods of time, as would be the case with A1 in the above example.

It will be understood of course that the low and high melting point materials could be sprayed in the correct proportions to fill porosity in this way using a cored wire comprising a steel sheath surrounding a low melting point material provided, for example, either in the form of a solid core , or in powder form. Such products are readily available.

EXAMPLE 4

This example illustrates one case where a large void was filled with low melting point alloy, and the low melting point alloy was subsequently remelted inside the void, after finishing the spray deposition process, in order to fill the porosity also present in the final product.

A complex shaped pattern was mounted on a manipulator and moved beneath two arc spray guns fed with 0.8% C steel wires. The manipulator was programmed to produce an even coating of sprayed metal with a minimum of shadowing. However, in this example, the shape of the pattern was such that shadowing could not be completely eliminated. The spraying of 0.8% C steel was halted briefly allowing time, while the deposit was still hot (approximately 250° C.), to apply flux to the area being affected by shadowing and then to infill the shadowed area with a tin/lead solder. The deposit was then allowed to cool until the solder was substantially solid. The spraying of 0.8% C steel was then continued, with spray conditions and manipulator setting which ensured that the deposit temperature did not rise above the melting point of the tin/lead solder.

In this way the void was filled before "bridging" was allowed to occur, and a sound tool was produced in a way that overcame the "shadowing" problems due to the inherent topographical features that existed on the substrate.

Filling large voids in this way thus brings the further benefit that sound tooling with more complex topographical features can be made, in cases where it would otherwise be difficult or impossible to produce such tooling by sprayforming.

In this particular case the deposit was then placed in an oven set at a temperature above the melting point of the solder, i.e. approximately 300° C., and soaked at that temperature for approximately one hour prior to then cooling slowly to room temperature. On subsequent sectioning and metallurgical examination it was further observed that porosity in the sprayed steel had been substantially filled with solder. In this case, therefore, both the large void and also the interconnected porosity had been satisfactorily filled.

Tools, dies, cores and other products made by the process of this invention can beneficially be used for a wide range of commercial applications in addition to plastic moulding and pressure die casting where the integrity and surface quality of the tooling used is important. Cooling channels are often an important feature of such tooling, and the facility to produce cooling channels and simultaneously reduce porosity is considered to be an important and synergistic aspect of the invention.

Filling of surface porosity as described is a particularly important aspect of the invention in relation to the manufacture of moulds tools and dies and the benefits of this are reflected in the quality of the product made from such moulds, tools and dies.

What is claimed is:

1. A process for reducing porosity and voids in a region of an article comprised of spray deposited material of a first, higher melting point composition, the process comprising embedding a material of a second, lower melting point composition within the sprayed deposit of material of the first composition during spraying, the temperature of the material of the second composition being elevated under conditions tailored to effect:

i) melting of at least a portion thereof; and, ii) flow of melted material of the second composition to penetrate and at least partially infill at least one of a porous region of, and void in, the body of the deposited material of the first composition.

2. A process according to claim 1, wherein a wetting agent is employed to enhance the process, particularly where at least one of the first and second composition material is metallic.

3. A process accordingly to claim 2, wherein the wetting agent comprises a flux material suitable for removing oxide skin formed at least one of during and subsequent to deposition.

4. A process according to claim 1, wherein the porous region and void is infilled by the molten material flowing under the influence of at least one of pressure and capillary type action.

5. A process according to claim 4, wherein the porous region and void is infilled by the molten material flowing induced by heating.

6. A process according to claim 1, wherein the material of the second composition material being melted to flow by subsequent heating of the article when substantially formed.

7. A process according to claim 1, wherein the material of the second composition being melted to flow by means of tailoring at least one of the spray temperature of the first composition material and the temperature of the deposit during spraying, wherein following embedding in the deposit, the melting point of the second material composition is attained by the effect of continued spraying.

8. A process for manufacturing an article by a spray deposition process, wherein molten sprays of a first and second material composition are sprayed contemporaneously to form the spray deposited article under spraying conditions tailored wherein, upon deposition, the material of the first composition solidifies to define boundaries between sprayed droplets the contemporaneously sprayed material of the second composition flowing to penetrate into a porosity network defined by the boundaries of the solidifying droplets of the deposited first material composition.

9. A process according to claim 1, wherein the spraying conditions are tailored such that at least one of oxidation of the surface of the porosity network of the deposit, and of the surface of the second material composition, are minimised during deposition.

10. A process according to claim 1, wherein a relatively unreactive gas is utilised in the spraying process.

11. A process according to claim 1 in which the first composition material is deposited by spraying atomised molten metal droplets forming splats upon impact with earlier deposited material thereby building up the article.

12. A process according to claim 1, in which the first composition material comprises steel.

13. A process according to claim 12, in which the steel is deposited by spraying as atomised droplets at a spray temperature substantially at or below 350 celcius (preferably at or below 300 celcius).

14. A process according to claim 11, wherein a martensitic phase transformation takes place in the deposited steel.

15. A process according to claim 1, wherein interconnected porosity is at least one of sealed and reduced in the article.

16. A process according to claim 1, wherein the material of the second composition is metallic.

17. A process according to claim 1, wherein the material of the second composition comprises a plastics material.

18. A method of manufacturing an article by a spray deposition process, the method comprising spraying material of a first composition to form a deposit and embedding a material of a second composition within the sprayed deposit of material of the first composition during spraying, the temperature of the material of the second composition being elevated under conditions tailored to effect:

(i) melting of a least a portion thereof; and (ii) flow of melted material of the second composition to penetrate and at least partially infill a porous region of, and void in, the body of the deposited material of the first composition.

19. An article comprised of spray deposited body of material of a first composition, deposited by spraying atomised molten metal droplets forming splats upon impact with earlier deposited material thereby building up the article, the body of spray deposited material having an interconnected porosity network defined between splats, the interconnected porosity network being at least one of partially infilled and sealed with solidified material of a second composition.

20. An article according to claim 19, wherein the porosity and void regions of the first composition deposited material is at least one of infilled, partially infilled and sealed with molten material of the second composition which subsequently solidifies.

21. An article according to claim 19, wherein the material of the second composition at least one of infills and seals porosity in the region of a surface of the article by penetrating the porosity network outwardly from a region in the body of the deposit.

22. An article according to claim 19, which comprises at least one of a tool, mould and die.

23. At least one of a tool, mould and die according to claim 22, wherein the material of the second composition infills or seals porosity in the region of a working surface of at least one of the tool, mould and die by penetrating the porosity network outwardly from a region in the body of at least one of the tool, mould and die.

24. An article according to any of claims 19 to 23, provided with internal cooling channels.

25. An article manufactured from at least one of a tool, mould and die manufactured according to claim 19.

26. A process according to claim 8 wherein the spraying conditions are tailored such that at least one of oxidation of the surface of the porosity network of the deposit, and of the surface of the second material composition, are minimized during deposition.

27. A process according to claim 8 wherein a relatively unreactive gas is utilized in the spraying process.

28. A process according to claim 8 in which the first composition material is deposited by spraying atomized molten metal droplets forming splats upon impact with earlier deposited material thereby building up the article.

29. A process according to claim 8 in which the first composition material comprises steel.

30. A process according to claim 9, wherein interconnected porosity is at least one of sealed and reduced in the article.

31. A process according to claim 8, wherein the material of the second composition is metallic.

32. A process according to claim 8, wherein the material of the second composition comprises a plastics material.

* * * * *